US009004055B2

(12) United States Patent
Laporte et al.

(10) Patent No.: US 9,004,055 B2
(45) Date of Patent: Apr. 14, 2015

(54) TARGET DELIVERY DEVICE

(75) Inventors: Jean-Michel Laporte, Biot (FR); Jean-Marc Fouques, Claviers (FR)

(73) Assignee: Laporte Holding (SAS), Biot (FR)

( * ) Notice: Subject to any disclaimer, the term of this patent is extended or adjusted under 35 U.S.C. 154(b) by 228 days.

(21) Appl. No.: 13/696,244

(22) PCT Filed: May 3, 2011

(86) PCT No.: PCT/EP2011/057069

§ 371 (c)(1),
(2), (4) Date: Jan. 15, 2013

(87) PCT Pub. No.: WO2011/138336

PCT Pub. Date: Nov. 10, 2011

(65) Prior Publication Data

US 2013/0125869 A1 May 23, 2013

(30) Foreign Application Priority Data

May 5, 2010 (FR) ..... 10 53480

(51) Int. Cl.

| | |
|---|---|
| ***F41J 9/30*** | (2006.01) |
| ***F41J 9/18*** | (2006.01) |
| ***F41J 9/20*** | (2006.01) |
| ***F41J 9/24*** | (2006.01) |

(52) U.S. Cl.
CPC .... *F41J 9/30* (2013.01); *F41J 9/18* (2013.01); *F41J 9/20* (2013.01); *F41J 9/24* (2013.01)

(58) Field of Classification Search
CPC ..... F41J 9/30; F41J 9/18
USPC ..... 124/6, 7, 8, 42, 47, 50
See application file for complete search history.

(56) References Cited

U.S. PATENT DOCUMENTS

| | | | | |
|---|---|---|---|---|
| 1,552,191 | A * | 9/1925 | Bahlmann | 124/26 |
| 1,638,283 | A * | 8/1927 | Bahlmann | 124/26 |
| 2,711,726 | A * | 6/1955 | Darrell | 124/6 |
| 3,603,301 | A * | 9/1971 | Darrell | 124/32 |
| 3,822,688 | A * | 7/1974 | Mayne | 124/6 |

(Continued)

FOREIGN PATENT DOCUMENTS

| | | |
|---|---|---|
| EP | 0580914 | 2/1994 |
| FR | 2587473 | 3/1987 |
| FR | 2787181 | 6/2000 |

OTHER PUBLICATIONS

PCT/ISA/237 Written Opinion issued on PCT/EP2011/057069 (pp. 5).

(Continued)

*Primary Examiner* — Melba Bumgarner
*Assistant Examiner* — Alexander Niconovich
(74) *Attorney, Agent, or Firm* — The Farrell Law Firm, P.C.

(57) ABSTRACT

The present invention relates to a device for delivering targets (2) comprising at least one column (4) for storing targets (2) capable of receiving a first target (11) at the lowest point of the column (4) and at least a second target (12) stacked on the first target (11), means for delivering the first target (11), and retention means for retaining the second target (12) in the column (4), characterized in that the retention means for retaining comprise a ramp (21) configured to exert a bearing force on the lower face of the second target (12) during the delivery of the first target (11).

This invention also relates to a machine for launching targets (2) equipped with a device and a method for distributing the targets (2).

13 Claims, 6 Drawing Sheets

(56) References Cited

U.S. PATENT DOCUMENTS

| | | | | | |
|---|---|---|---|---|---|
| 3,841,293 | A | * | 10/1974 | Laporte et al. | 124/8 |
| 3,937,203 | A | * | 2/1976 | Riedmueller et al. | 124/8 |
| 4,048,976 | A | * | 9/1977 | Alday et al. | 124/47 |
| 4,146,007 | A | * | 3/1979 | Alday et al. | 124/9 |
| 4,248,202 | A | * | 2/1981 | Jaworski et al. | 124/16 |
| 4,706,641 | A | * | 11/1987 | Cote et al. | 124/8 |
| 4,747,390 | A | * | 5/1988 | Storm | 124/6 |
| 4,967,720 | A | * | 11/1990 | McCord et al. | 124/8 |
| 5,036,828 | A | * | 8/1991 | Heffer | 124/47 |
| 5,050,575 | A | * | 9/1991 | Killion | 124/8 |
| 5,259,360 | A | * | 11/1993 | Panara et al. | 124/50 |
| 5,406,928 | A | * | 4/1995 | Panara et al. | 124/8 |
| 5,720,664 | A | * | 2/1998 | Brubacher | 463/52 |
| 5,771,874 | A | * | 6/1998 | Kohler | 124/8 |
| 5,871,003 | A | * | 2/1999 | Laporte et al. | 124/9 |
| 5,970,969 | A | * | 10/1999 | Anttila et al. | 124/8 |
| 6,026,796 | A | * | 2/2000 | LaPorte et al. | 124/7 |
| 6,588,410 | B1 | * | 7/2003 | Graber | 124/8 |

OTHER PUBLICATIONS

English translation of Written Opinion dated Nov. 6, 2012 issued in corresponding International Appln. No. PCT/EP2011/057069.

* cited by examiner

TARGET DELIVERY DEVICE

PRIORITY

This application is a U.S. National Phase application from International Application No. PCT/EP2011/0057069 filed May 3, 2011, with a claim of priority to Application No. 1053480 filed with the French Industrial Property Office on May 5, 2010, the contents of each of which is incorporated herein by reference.

This invention relates to a device for distributing targets and a machine equipped with such a device and a method for distributing the targets.

In particular, the invention concerns the launching of targets for archery purposes, although this application is not restrictive. In particular, the invention may be used with various target shapes and materials.

Target launching devices are already known and in particular document EP-A1-580 914 describes a system for delivering targets equipped with a cylinder equipped with several columns for stacked storing of the targets in the columns. When approaching the delivery area, the bottom target in the column is moved towards a plane below the latter, while the target situated immediately above and the others that may be situated above that are maintained by a lateral force applied to the edge of the target immediately above in order to hold it back. This design requires the use of fairly complex means for applying the lateral force that need to be powerful enough to retain all the targets in the column. This means that the necessary structure is complex. Moreover, the need to apply a large force to the edge of the target does not eliminate the risks of the latter being damaged. This problem is all the more acute when the archery targets are made of a polymer foam.

In particular, it is observed that exercising the lateral force of the target retention system leads to out-of-round polymer foam targets and, when the means for applying the force remain in contact with the target for a long time, target plastification and compression set could occur and cause irremediably damage to it.

The purpose of the invention is to improve the retention of the target positioned above the target being delivered from a column.

This is the context of the present invention that describes an improved device for delivering targets. The delivery device according to the target comprises at least one column for storing targets capable of receiving a first target at the lowest point of the column and at least a second target stacked on the first target, means for delivering the first target, and retention means for retaining the second target in the column.

The invention is characterised in that the retention means for retaining comprise a ramp configured to exert a bearing force on the lower face of the second target during the delivery of the first target.

Thanks to the invention, the targets are retained in the column without exerting a radial force by a simple stop that counters the force of gravity on the targets in the column above the target to be delivered.

According to one advantageous aspect of the invention, the retention means gradually replace the force exerted by the target to be delivered on the other targets by a deviation of the target to be delivered so as to enable a space to be liberated on the lower face of the second target in order to coact with the retention means.

According to another advantageous embodiment of the invention, the retention means in question in the form of a ramp are extended along the path of the storage column so as to act as a lower stop in the column during a large part of the column path. Thus, only one means is used to execute the active ramp on delivery of the first target and the retention stop in the active column during a wider operating phase of the device.

Other aims and advantages will become apparent during the following description of a preferred embodiment for illustration purposes of the invention which is not restrictive.

Firstly, and complementarily, the different embodiments that can be implemented by the invention, alternatively or cumulatively, are described below:

it comprises the means for driving the column in a cyclical trajectory, the trajectory is circular on an axis parallel to the direction of target stacking in the column, the delivery means comprise a surface for receiving the first target on a first section of the column trajectory at a height that is less than the height of the column, the means for deflecting the first target on the receiving surface are configured to create a lateral offset between the first target and the second target during the trajectory of the column and the ramp is configured to bear on a zone region of the lower face of the second target laterally offset relative to the first target, the ramp has an end that is inclined towards the receiving surface, the ramp is extended by a stop surface extending on the second section of the column trajectory supplementary to the first section the stop surface comprises an end that is sloping in the direction of the receiving surface, the targets are the same height, and the difference in height between the column and the receiving surface is substantially equal to the height of the targets, it comprises means for pushing the first target on the receiving surface, the said pushing means being integral with the movement of the column, the column has an inner cylindrical volume that is defined by multiple parallel rods, it has several columns and the means for pushing comprise an extension in the direction of the receiving surface of at least one column rod following that of the first target on the column trajectory, the delivery means comprise an inclined wall at the exit from the receiving surface.

The invention also relates to the machine for launching targets used to practice shooting and comprising a delivering device according to the invention.

The invention relates to a process for delivering targets that comprises stages consisting in storing multiple targets in at least one column for storing targets capable of receiving a first target at the lowest point of the column and at least a second target stacked on the first target, delivering the same target, retaining the second target in the column, characterised in that the second target is retained in the column during delivery of the first target by bearing on the underside of the first target.

In a preferred arrangement, this method comprises stages consisting in driving the column on a cyclical trajectory, passing the first target of the column onto a receiving surface and pushing the first target onto the receiving surface, retaining the second target stacked on the first target while creating a lateral offset between the first target and the second target by deviating the first target, exerting a bearing force on the underside of the second target in the region positioned in the lateral offset and pursuing the push of the first target until the first target and the second target are no longer stacked one on the other.

The accompanying drawings are given as examples and do not limit the invention. They represent only one embodiment of the invention and will enable it to be easily understood.

Figure 4:
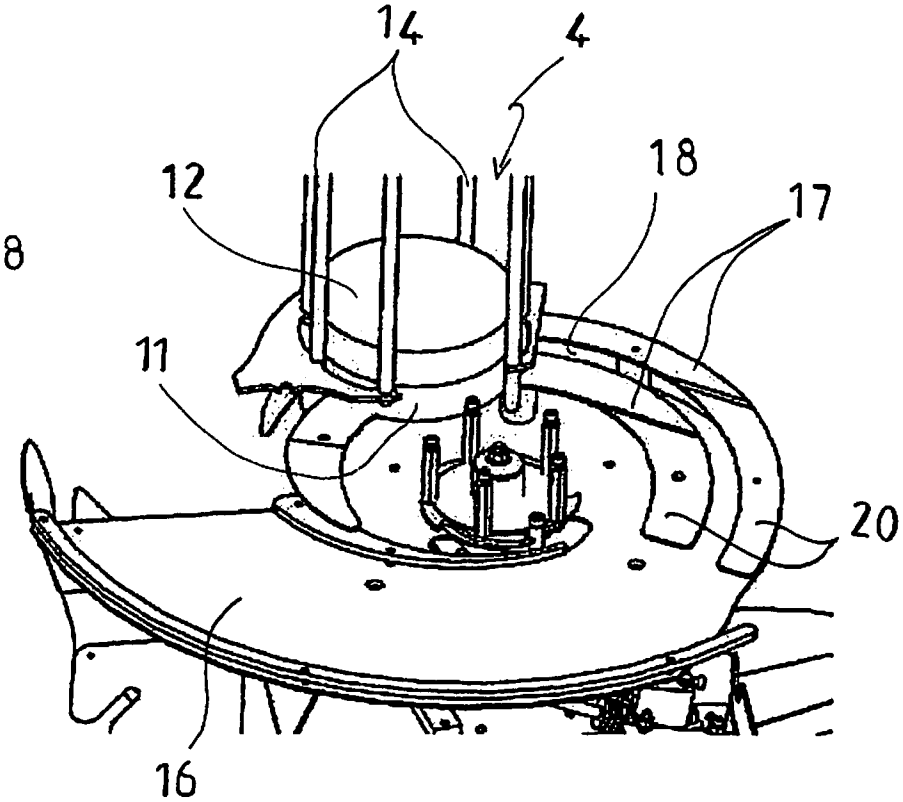
FIGS. 3 and 4 show respectively a top view and a view in perspective of the target delivery device according to the invention during its first stage of operation.
Figure 3:
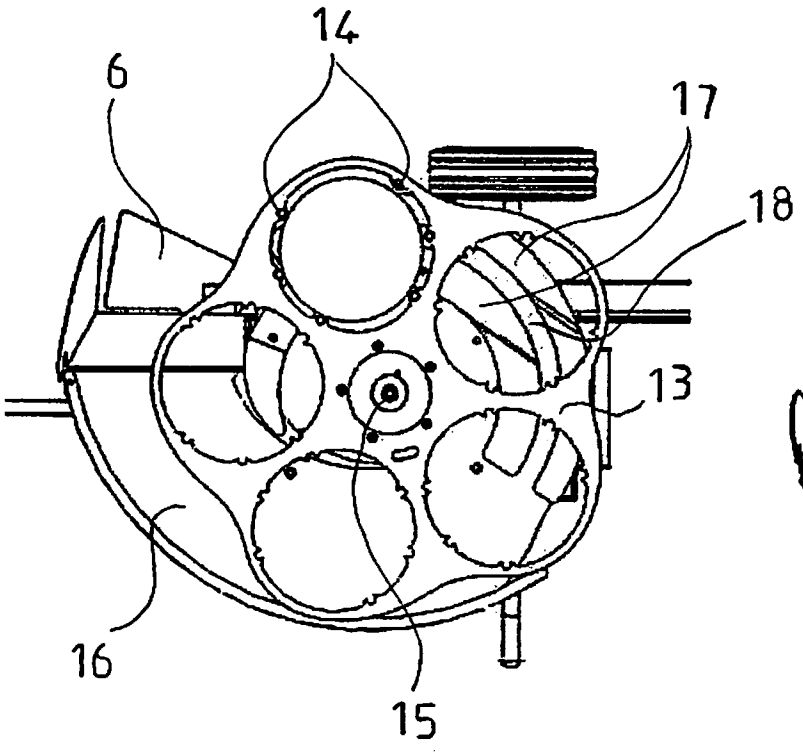
Figure 8:
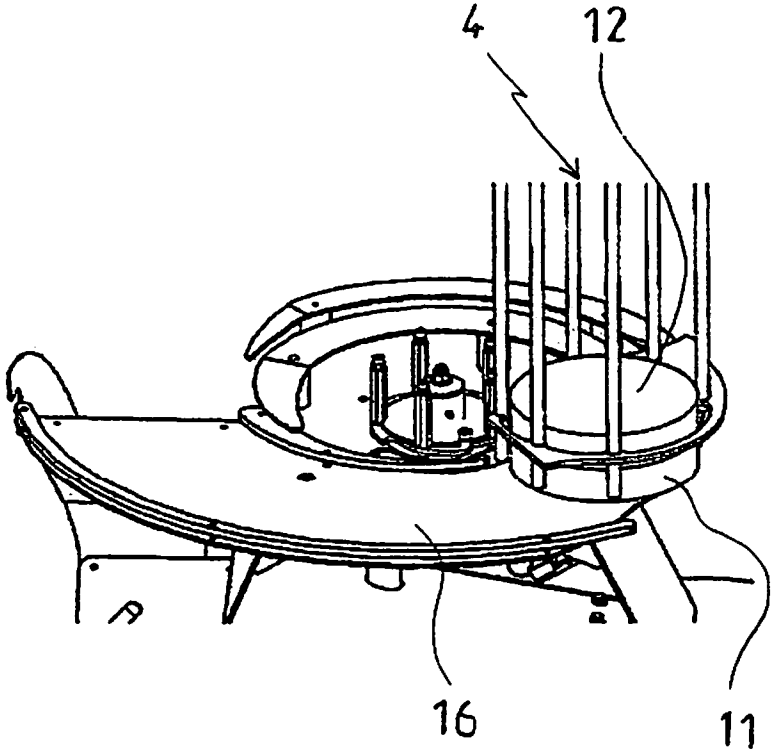
Figure 7:
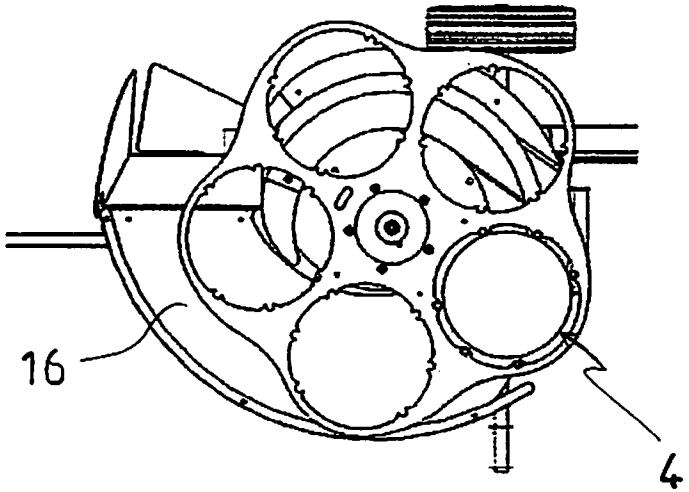

FIGS. 7 and 8 correspond respectively to the FIGS. 3 and 4 during a third stage of operation.

Figure 9:
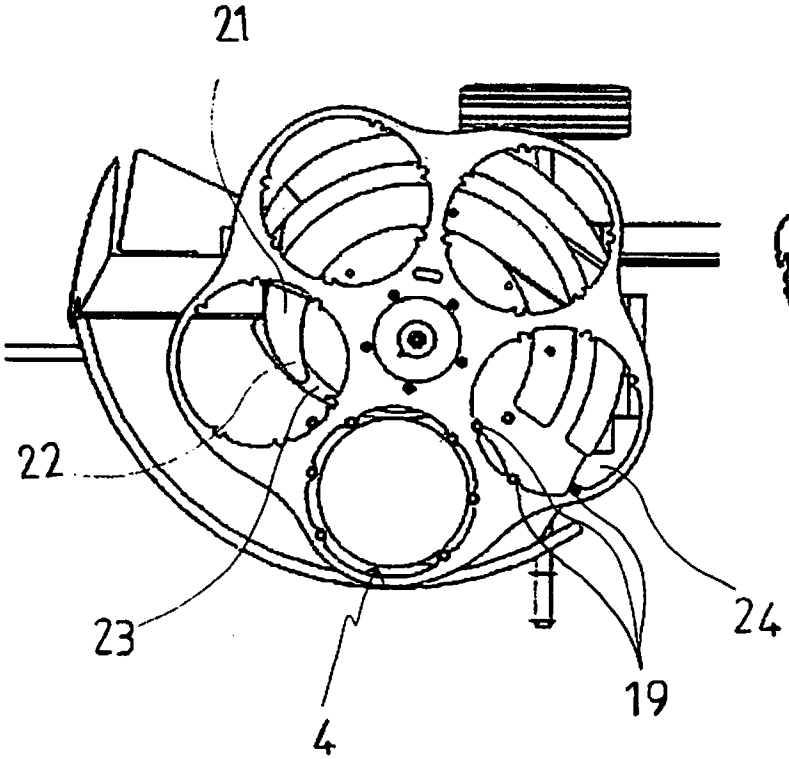

FIGS. 9, and to 10 correspond respectively to FIGS. 3 and 4 during a fourth stage of operation.

Figure 12:
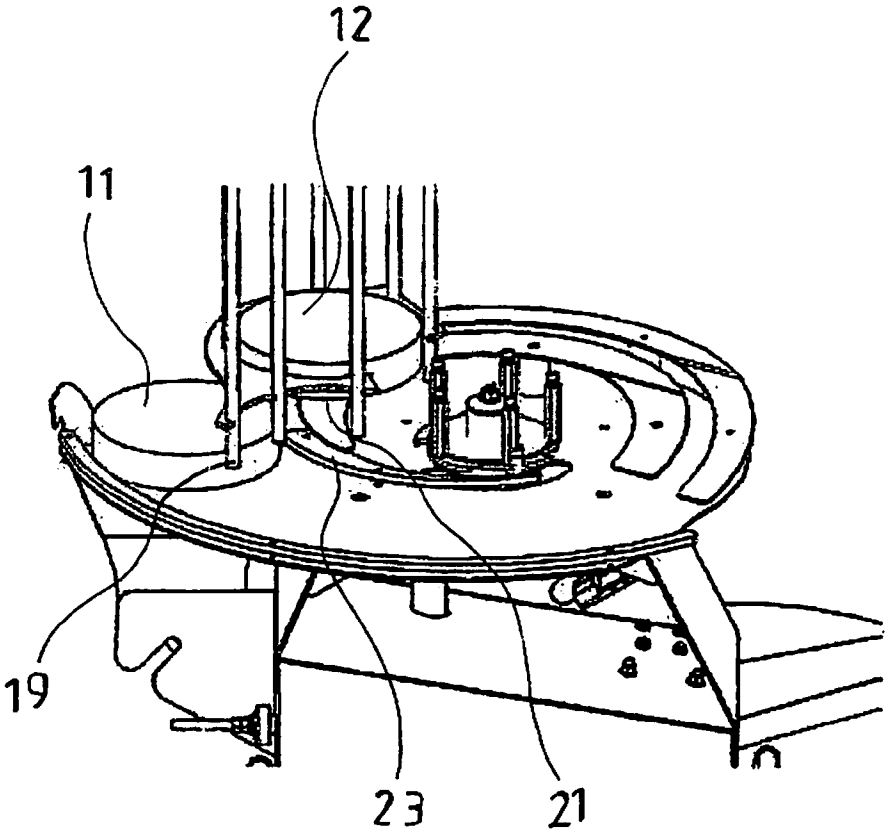
Figure 11:
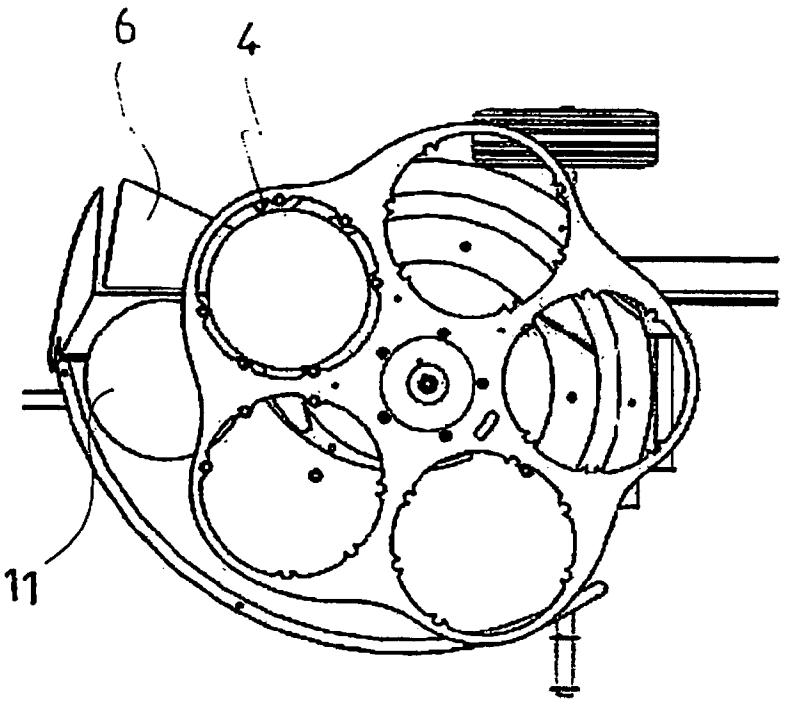

FIGS. 11 and 12 correspond respectively to FIGS. 3 and 4 during a fifth stage of operation.

Figure 2:
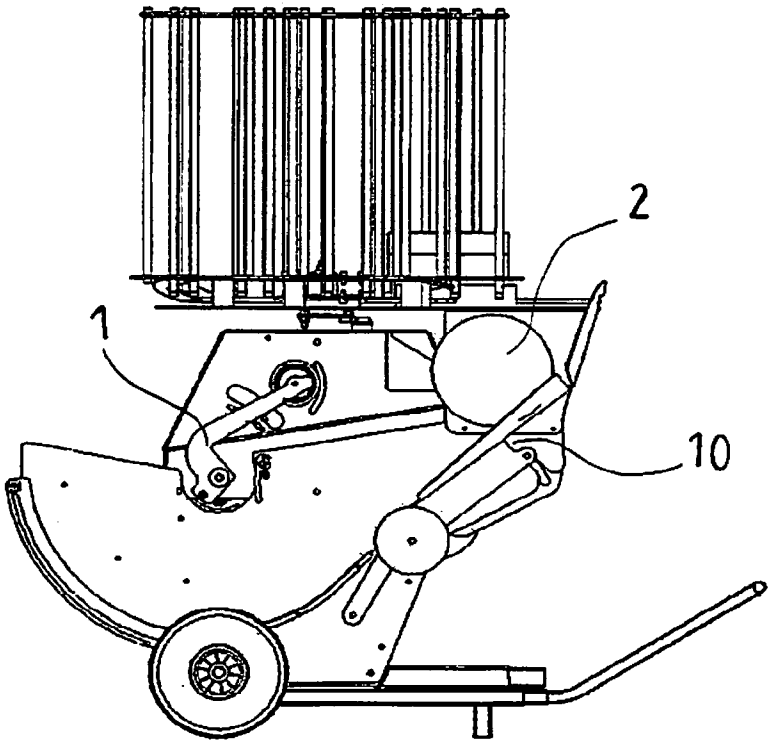
FIG. 2 shows the same side view with the target during delivery.
Figure 1:
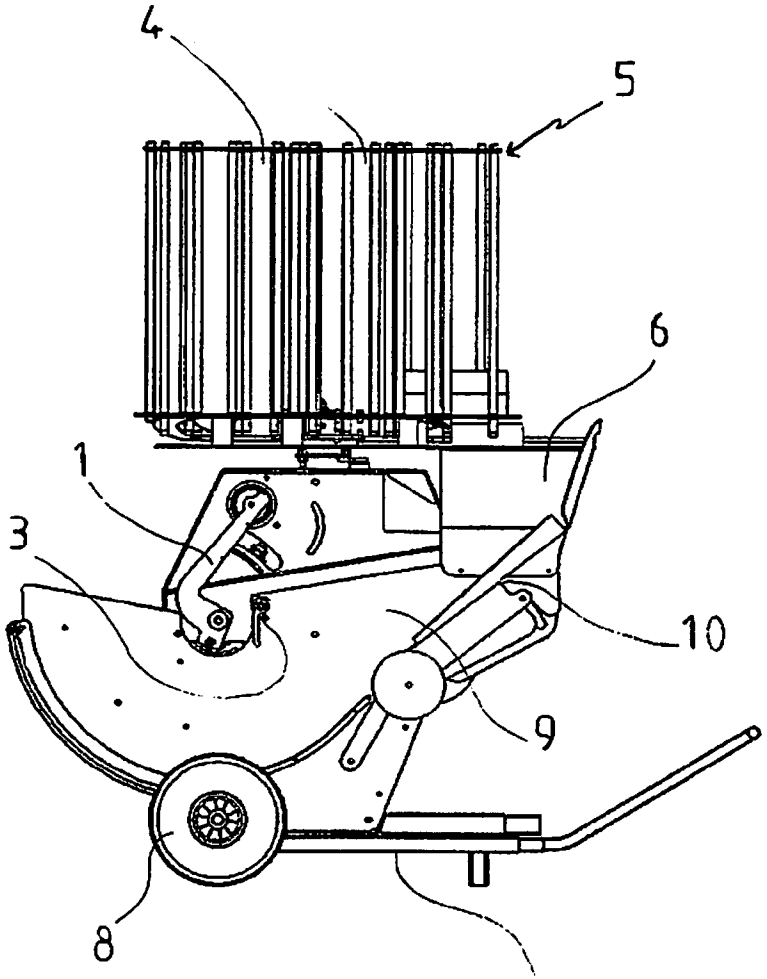
FIG. 1 shows a side view of the target launching machine equipped with a device according to the invention for delivering the targets.

The machine illustrated in FIGS. 1 and 2 is configured to launch targets 2 using a launch arm 1 equipped with rotational actuating means, the target 2 being launched when it is oriented substantially vertically. However, this example of the invention is not restrictive and other launch directions and targets covered by the present application.

The size and the shape of the material used for the target 2 is not limited.

Advantageously, in archery, the target 2 will consist of a cylindrical part of around 15 to 400 mm diameter and 30 to 150 mm thickness and, more preferably for competition targets, 245 mm diameter and 50 mm thickness made of a polymer foam material. In a preferred arrangement, the target is made of a plastic polymer foam material. The target 2 may consist of a sandwich of several layers of polymer foam, notably with a central layer that is harder than the two layers positioned laterally on either side of the central layer.

In a preferred arrangement, the thickness of the central layer is between 20 and 90 mm and in particular around 30 mm.

As to the peripheral layers, a thickness of around 7 to 20 mm, and 10 millimeters in particular, has been shown to be particularly effective.

In the example in FIG. 1, the machine comprises a cylinder 5 surmounting the launching part equipped with the launch arm 1, the cylinder 5 being equipped with multiple columns 4. The columns 4 enable the target to be received and stacked before delivery for launching. There is no restriction on the number of the columns 4. Once released from the column 4, the target 2 is delivered to unloading zone 9, ready to coact with the launch arm 1. In the example described, delivery takes place through a sloping plane 6 that acts as a slide bringing the target 2 down towards a chute 10 that receives the target 2 slightly upstream of the launch arm 1. The target 2 is then brought to a stop 3 that slightly retains the target 2 before it is launched by the rotation of the launch arm 1.

The machine may also be equipped with a base 7 equipped with wheels 8 for moving the machine.

Below is a more precise description of a preferred embodiment of the target delivery device used in the machine shown in FIGS. 1 and 2.

FIGS. 3 to 12 show a cylinder 5 arranged parallel to a base 13 that constitutes the lower structure of the cylinder 5, and a partial view of the column 4. However, other holes are also shown in the base 13 in order to constitute the target delivery zone in multiple columns, that is to say, five columns in the example shown. In a preferred arrangement, the cylinder 5 is equipped with a structure that complements the base 13 and is positioned higher; the base 13 and the complementary structure being connected by multiple rods 14, advantageously in metal, all the rods 14 being placed on a same circle in order to define an inner storage volume for the stacked targets 2.

The column 4, in a corresponding manner, all of the cylinder 5, is driven by means that are not shown (for example, an electric motor) in a cyclical trajectory. Thus, the column 4 is able to pass through the different operating stations of the delivery device, and in particular by a station for the delivery of the first target, and a station for pursuing the trajectory. For the sake of simplicity, the trajectory chosen is advantageously circular on an axis of rotation 15 oriented parallel to the direction of target stacking that corresponds substantially to the longitudinal direction of the rods 14.

In the example shown, the column 4 is rotated by the base 13 being driven by the axis of rotation 15. In the different FIGS. 3 to 12, the direction of rotation is clockwise but this is not restrictive.

Whereas the base 13 makes up substantially the lowest part of each column 4, the delivery device also comprises a receiving surface 16 below the bottom of column 4 in order to receive the first target 11 to be delivered. FIG. 3 shows in particular that the receiving the surface 16 is extended by the sloping wall 6 referred to previously, thereby enabling the target 11 to enter the loading zone 9 of the launch machine.

In the example shown, the receiving surface 16 is substantially flat and parallel to the base 13 and is therefore perpendicular to the axis of rotation 15. However, this is not restrictive and in particular the receiving surface 16 may be slightly sloping in the direction of the ramp 6 in order to facilitate the descent and the delivery of the first target 11.

The different operating stages of the device are described in greater detail below and shown by the different positions of the column 4 during its trajectory.

On FIGS. 3 and 4, the column 4 is positioned much further upstream of the receiving surface 16 relative to the direction of its movement. In this configuration, the targets (only the first target 11 has been shown and a second target 12 in the column 4 although other targets can be stacked above the second target 12) are held laterally in the column 4 by the rods 14. Moreover, the downward movement of the targets is prevented by a stop 17 applied on the underside of the first target 11. In the example shown, the stop 17 is in two parts making up arcs centred on the axis of rotation 15. The two-part stop 17 defines, between these two parts, a passage 18 that is also an arc centred on the axis of rotation 15 for reasons that will be detailed further on.

In a preferred arrangement, the stop 17 is a surface parallel to the underside of the first target 11 corresponding to a plane perpendicular to the axis of rotation 15.

Figure 6:
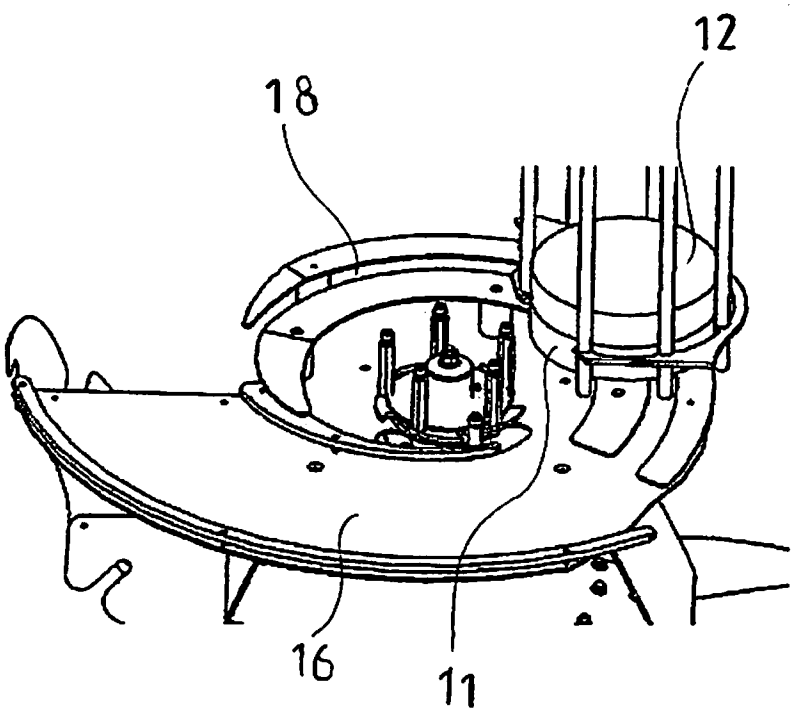
FIGS. 5 and 6 are views corresponding respectively to FIGS. 3 and 4 during its second stage of operation.
Figure 5:
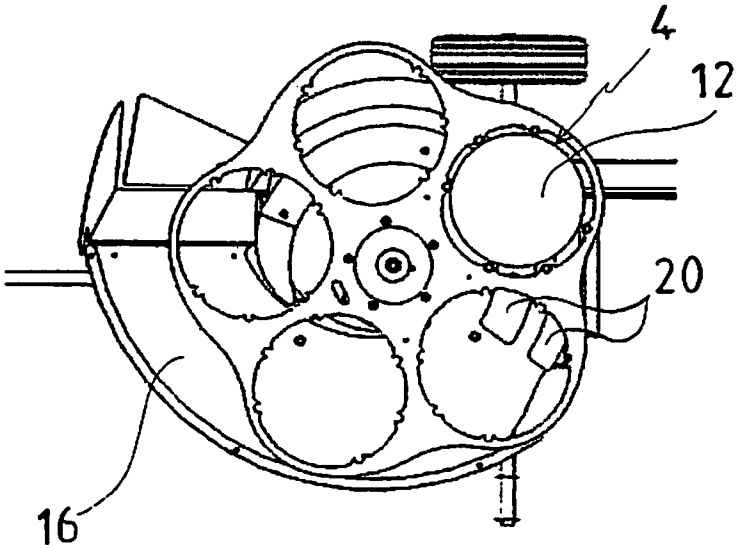

The FIGS. 5 and 6 show a later phase of the rotation of the column 4. In this second arrangement, the column 4 has moved along the stop 17 up to a sloping end 20 thereof. The sloping end 20 constitutes a surface facilitating the downward movement of the first target 11 in the direction of the receiving surface 16.

On FIGS. 7 and 8, the column 4 has again advanced in the clockwise direction to reach the end of the sloping end 20 of the stop 17. In this position, the upstream part of the first target 11 engages onto the receiving surface 16. As shown, the first target 11 is then at a level below the lowest level of the storage column 4, which is the last position of the second target 12. In an advantageous arrangement, the height offset between the receiving surface 16 and the lower part of the column 4 comprised of the base 13 is substantially equivalent to the height of one target. In this way, in this phase of engaging onto the receiving surface 16, the first target 11 acts as a stop to the second target 12 in order to retain it in the column 4.

In this preferred example, no other retention means for retaining the target 12 in the column 4 is required at this stage.

Figure 10:
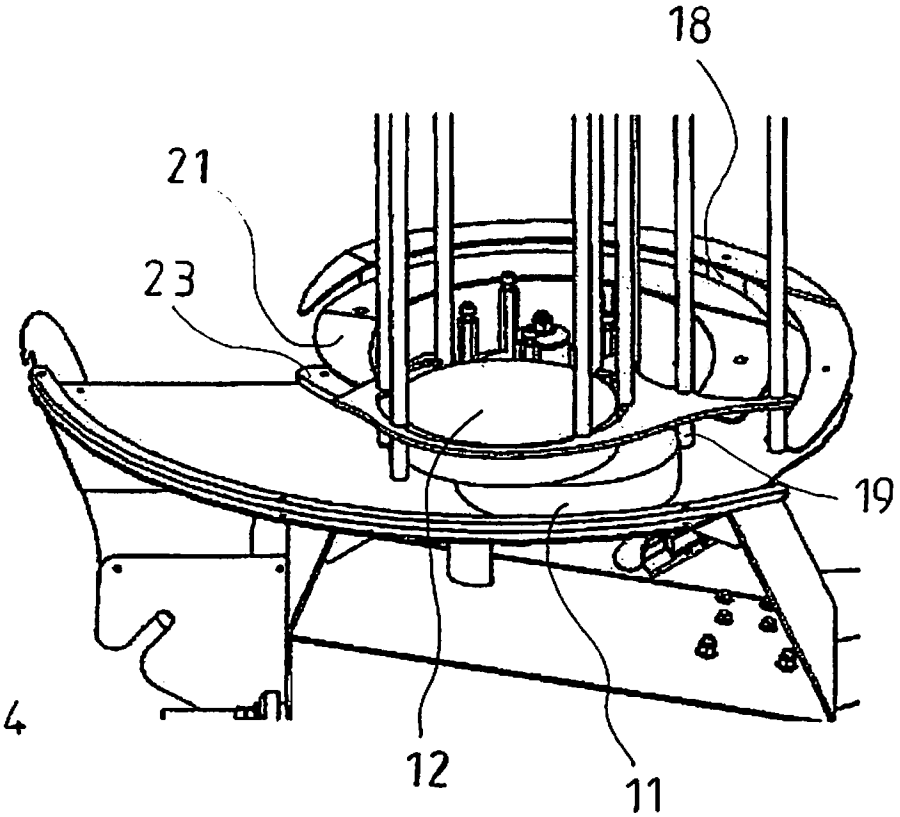

During its rotational progression, the column 4 reaches a position that is shown on FIGS. 9 and 10. It will be observed that the column 4 has moved forwards although the first target 11 is no longer driven by it. Indeed, at this stage, the first target 11 is released from the column 4. On the other hand, the means for applying push are present and advantageously integral with the assembly moving in rotation and comprising the cylinder 5 in order to ensure that the push of first target 11 will move it forwards in the direction of the sloping wall 6. In a preferred arrangement, the means for applying push comprise at least one extension 19 executed in the continuity of the lower part of certain rods 14 of the storage column 24 situated behind the column 4, where the first target 11, was initially present following the direction of rotation of the column 4. In the example shown, FIG. 9 illustrates the storage column 24 with three rods 14 shown diagrammatically by a circular section in slightly heavier lines. It will be easily understood that continuing the rotation of column 4, and the offset between this column and the push means comprised of the extensions 19 create a lateral offset between the target 11 and the target 12.

A lateral offset between the push means and of the column 4 produces a lateral offset between the target 11 and the target 12, thereby creating a first element for deviating the target 11.

In addition or alternatively, the device has visible deviation means 23, especially visible on the top view in FIG. 9, and defining a surface of the slide type capable of being applied on the edge of the first target 11 during its continued rotation. The deviation means 23 form a deflector capable of orienting the first target 11 radially towards the exterior relative to the rotational movement of the column 4.

This movement towards the exterior of column 4 by the first target 11 is particularly visible on FIGS. 11 and 12 that show the first target 11 that is substantially offset laterally relative to the second target 12 remaining in the column 4.

Whereas, until now, the first target 11 could suffice to retain the second target 12 in the column 4, this retention could be altered insofar as the target 11 is about to be definitively delivered. Thus, according to the invention, retention means are provided to replace the bearing force that until now has been provided by the upper surface of the first target 11. These retention means comprise a ramp 21, one example of which is shown on the different figures, and especially on FIGS. 9 and 10. The ramp 21 is positioned so that it bears on the underside of the second target 12 when lateral offset occurs. It will be observed that there is no need for the ramp 21 to be present right from the creation of this offset insofar as the first target 11 is then largely bearing on the second target 12.

In the example shown, the ramp 21 is situated at the level of the deviation means 23, with the joint presence of the deviation means 23 and the ramp 21 ensuring that the first target 11 cannot interfere with the retention means consisting of the ramp 21. This ensures that no jamming may occur. In the example shown, the ramp 21 has an upstream end (in the direction of rotation) sloping in the direction of the receiving surface 16. In this way, fitting the second target 12 on the ramp 21 is guaranteed even when the ramp 21 descends slightly below the underside of the second target 12. This improves the reliability of the device.

As a further preferred arrangement, the ramp 21 is prolonged by the surface of the stop 17 so as to continue maintaining the second target 12 in position. This has the further advantage of only requiring a single structural component in order to carry out these different functions.

On FIGS. 11 and 12, the bearing relay performed by the first target 11 remains in effect at the level of the ramp 21. Rotation of the column 4 may be pursued until the cycle started by the phase shown on the FIGS. 3 and 4 is restarted.

Between the stage of FIGS. 11 and 12 and the FIGS. 3 and 4, it will be easily understood that the rotation of the cylinder 5 pursues the push action of the extensions 19 on the first target 11 so as to cause it to descend onto the sloping side 6. A rotation cycle then takes the second target 12 at this time following the exiting of the first target 11 in the preceding description. It will be noted that the rotation of the cylinder 5 takes place advantageously step-by-step so as to produce different operating phases associated with the successive natures of the launching of the targets by the launch arm 1. It will be noted that the creation of the extensions 19 as continuities of certain of the rods 14 avoids recourse to additional push means. Benefit will also be drawn from a community of structures in order to execute the different functions. In so far as the rotation of the extension 19 could interfere with the ramp 21 and the stop 17, these two latter surfaces are advantageously executed so as to allow the passage of the extensions 19 around these surfaces during the rotation of the cylinder 5. Thus, the surface of the two-part stop 17 allows the passage of at least one extension 19 in the passage 18.

It will be noted that the distribution arrangement described does not require any controlled means, in particular involving the use of an electromechanical system.

REFERENCES

1. Launch arm
2. Target
3. Stop
4. Column
5. Cylinder
6. Inclined side
7. Base
8. Wheel
9. Loading zone
10. Chute
11. First target
12. Second target
13. Base
14. Rod
15. Axis of rotation
16. Receiving surface
17. Stop
18. Passage
19. Extension
20. Inclined end
21. Ramp
22. Inclined end
23. Deviation means
24. Following column

The invention claimed is:

1. A device for target distribution, the device comprising:

a column configured to rotate and to store a plurality of targets;

a ramp configured to apply a bearing force on an underside of a second target of the plurality of targets during delivery of a first target of the plurality of targets;

a receiving surface; and a deflector, wherein the column is configured to store the first target at a lowest point of the column and to store the second target of the plurality of targets stacked on the first target, wherein the bearing force retains the second target in the column during delivery of the first target, wherein the deflector is configured to laterally offset the first target when the ramp applies the bearing force on the underside of the second target, when the column rotates.

2. The device of claim 1, wherein the column rotates in a cyclical trajectory circling an axis of rotation parallel to a direction of stacking of the plurality of targets in the column.

3. The device of claim 1, wherein the ramp comprises an end that is sloping towards the receiving surface.

4. The device of claim 3, wherein the ramp includes a stop surface.

5. The device of claim 4, wherein the stop surface comprises an end sloping towards the receiving surface.

6. The device of claim 1, wherein the plurality of targets are of a same height, and wherein a difference in height between the column and the receiving surface is substantially equal to the height of the plurality of targets.

7. The device of claim 1, comprising a pusher configured to push the first target along the receiving surface, the pusher being integral with and rotates with the column.

8. The device of claim 7, wherein the column has a cylindrically shaped inner volume defined by a plurality of parallel rods.

9. The device of claim 8, wherein the pusher comprises an extension of one rod of the plurality of rods, with the extension extending towards the receiving surface.

10. The device of claim 9, wherein the receiving surface comprises a sloping side at an exit.

11. The device of claim 1, wherein the plurality of targets are formed of a plastic polymer foam material and have a plain cylindrical shape.

12. A method for target delivery, the method comprising:

retaining a plurality of targets in a column with a first target of the plurality of targets positioned at a lowest point of the column and a second target of the plurality of targets stacked on the first target;

driving the column along a cyclical trajectory;

passing the first target onto a receiving surface;

creating a lateral offset between the first target and the second target;

exerting a bearing force on an underside of the second target to separate the first target from the second target;

pushing the first target along the receiving surface, and delivering the first target while retaining the second target in the column.

13. A target distribution device comprising:

a column configured to store a plurality of targets and to rotate about an axis;

a ramp configured to apply a bearing force on an underside of a second target of the plurality of targets to separate the second target from a first target of the plurality of targets on which the second target is stacked, while retaining the second target in the column during delivery of the first target;

a receiving surface configured to receive the first target;

a deflector configured to deflect and laterally offset the first target onto the receiving surface when the column rotates; and a pusher configured to push the first target on the receiving surface, wherein the pusher is integral with and rotates with the column.

* * * * *